US005663125A

United States Patent [19]

Ishimaru et al.

[11] Patent Number: 5,663,125

[45] Date of Patent: Sep. 2, 1997

[54] LUBRICATING OIL FOR TWO-CYCLE ENGINES

[75] Inventors: Mitsuaki Ishimaru; Mineo Kagaya; Noboru Ishida, all of Yokohama, Japan

[73] Assignee: Nippon Oil Co., Ltd., Tokyo, Japan

[21] Appl. No.: 685,017

[22] Filed: Jul. 22, 1996

Related U.S. Application Data

[62] Division of Ser. No. 307,622, Sep. 20, 1994, abandoned.

[30] Foreign Application Priority Data

Jan. 20, 1993 [JP] Japan ..... 5-007908

[51] Int. Cl.[6] ..... C10M 139/00; C10M 141/12

[52] U.S. Cl. ..... 508/194

[58] Field of Search ..... 508/194; C10M 139/00, C10M141/06, 141/12

[56] References Cited

U.S. PATENT DOCUMENTS

| | | | |
|---|---|---|---|
| 2,536,685 | 1/1951 | Harman | 252/46.6 |
| 2,813,129 | 11/1957 | Benoit | 260/615 |
| 3,871,837 | 3/1975 | Bedague | 44/58 |
| 3,966,625 | 6/1976 | Tanizaki | 252/52 A |
| 4,493,776 | 1/1985 | Rhodes | 252/25 |
| 4,705,643 | 11/1987 | Nemo | 252/51.5 A |
| 5,143,640 | 9/1992 | Moxey | 252/52 A |
| 5,330,667 | 7/1994 | Tiffany, III | 252/49.6 |
| 5,342,531 | 8/1994 | Walters | 252/32.5 |

FOREIGN PATENT DOCUMENTS

| | | |
|---|---|---|
| 0 297 996 | 1/1989 | European Pat. Off. . |
| 0 523 560 | 1/1993 | European Pat. Off. . |
| 47-9481 | 5/1972 | Japan . |
| 48-74507 | 10/1973 | Japan . |
| 54-160401 | 12/1979 | Japan . |
| 62-52799 | 11/1987 | Japan . |
| WO91/13950 | 9/1991 | WIPO . |

*Primary Examiner*—Jerry D. Johnson

*Attorney, Agent, or Firm*—Cushman Darby & Cushman Intellectual Property Group of Pillsbury Madison & Sutro LLP

[57] ABSTRACT

A lubricating oil for two-cycle engines, which comprises a polyoxyalkylene glycol derivative represented by the following formula as a base oil, can be used to lubricate bearing portions and frictional portions of an two-cycle engine, so that the engine can be remarkably improved in generation of smoke, starting performance, cleanliness to prevent its exhaust system from clogging with carbon, cleanliness at high- or low temperature, and anti-seizure performance.

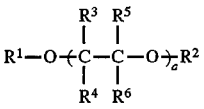

2 Claims, No Drawings

LUBRICATING OIL FOR TWO-CYCLE ENGINES

This is a division of application Ser. No. 08/307,622, filed Sep. 20, 1994, now abandoned.

TECHNICAL FIELD

The present invention relates to a lubricating oil for two-cycle engines. More specifically, it relates to a lubricating oil for two-cycle engines, by the use of which an engine can remarkably reduce smoke, remarkably improve starting performance, be kept clean, even at high or low temperature, enough to prevent its exhaust system from clogging with carbon, and have an excellent anti-seizure performance.

BACKGROUND ART

Due to its lubricating mechanism, a two-cycle engine releases unburnt lubricating oil together with exhaust gas, which causes smoke.

From the viewpoint of environmental pollution, it has been desired to reduce smoke as much as possible. In Japan, there has already been extensively marketed low-smoke types of lubricating oil for two-cycle engines whose base oil contains polybutene or polyisobutylene as a major component that generates smoke less than mineral oils.

However, since polybutene accelerates friction between a piston and a cylinder due to its viscosity(stickiness), it inevitably reduces engine power more than mineral oils. Furthermore, starting becomes hard or troublesome when such a type of oil is applied in motors whose capacity is too small to start with a starter motor, or recoil types of engine such as a lawn-mower engine started by winding and then pulling a string around a crank pulley, a chain saw or a generator.

Polybutene has been considered to cause clogging with carbon in an exhaust system less frequently than mineral oils. It, however, has been reported that polybutene produces more emulsion sludge at low temperature than mineral oils when used in particular two-cycle engines, for example, an engine of a motorcycle used for newspaper delivery which is exposed to frequent repetition of start-and-stop. Clogging of an exhaust system with carbon or emulsion causes deterioration of combustion performance of an engine, which leads to reduction of engine power.

Therefore, it has been desired to develop a lubricating oil for two-cycle engines which can maintain their cleanliness to minimize power reduction, deterioration of starting performance and carbon clogging of their exhaust system.

As the result of extensive researches to develop a lubricating oil suitable for two-cycle engines, the present inventors have found that a lubricating oil whose base oil is a polyalkylene glycol derivative with a particular structure is much more preferable with regard to engine power, starting performance and reduction of carbon clogging of an exhaust system than commercially available, conventional lubricating oils.

DISCLOSURE OF THE INVENTION

The present invention provides a lubricating oil for two-cycle engines which contains a polyalkylene glycol derivative of formula (1) (hereinafter referred to as "component A") as a base oil.

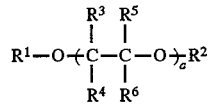

(1)

In this formula, $R^1$ and $R^2$ represent hydrogen atoms; alkyl groups having 1 to 22 carbon atoms; cycloalkyl or alkylcycloalkyl groups having 5 to 20 carbon atoms; or aryl, alkylaryl or arylalkyl groups having 6 to 20 carbon atoms. Specifically, $R^1$ and $R^2$ include hydrogen atoms; alkyl groups such as methyl, ethyl, propyl, butyl, pentyl, hexyl, heptyl, octyl, nonyl, decyl, undecyl, dodecyl, tridecyl, tetradecyl, pentadecyl, hexadecyl, heptadecyl, octadecyl, nonadecyl and eicosyl groups, and isomeric forms thereof; alkenyl groups such as propenyl, isopropenyl, butenyl, pentenyl, hexenyl, heptenyl, octenyl, nonenyl, decenyl, undecenyl, dodecenyl, tridecenyl, tetradecenyl, pentadecenyl, hexadecenyl, heptadecenyl, octadecenyl, nonadecenyl and eicosenyl groups, and isomeric forms thereof; cycloalkyl groups such as cyclopentyl, cyclohexyl and cycloheptyl groups; alkylcycloalkyl groups such as methylcyclopentyl, ethylcyclopentyl, propylcyclopentyl, butylcyclopentyl, dimethylcyclopentyl, ethylmethylcyclopentyl, diethylcyclopentyl, dipropylcyclopentyl, dibutylcyclopentyl, methylcyclohexyl, ethylcyclohexyl, propylcyclohexyl, butylcyclohexyl, dimethylcyclohexyl, ethylmethylcyclohexyl, diethylcyclohexyl, dipropylcyclohexyl, dibutylcyclohexyl, methylcycloheptyl, ethylcycloheptyl, propylcycloheptyl, butylcycloheptyl, dimethylcycloheptyl, ethylmethylcycloheptyl, diethylcycloheptyl, dipropylcycloheptyl and dibutylcycloheptyl groups, and isomeric forms thereof; aryl groups such as phenyl and naphthyl groups including all isomeric forms thereof; alkylaryl groups such as tolyl, ethylphenyl, propylphenyl, butylphenyl, pentylphenyl, hexylphenyl, heptylphenyl, octylphenyl, nonylphenyl, decylphenyl, undecylphenyl, dodecylphenyl, xylyl, ethylmethylphenyl, diethylphenyl, dipropylphenyl, dibutylphenyl, methylnaphthyl, ethylnaphthyl, propylnaphthyl, butylnaphtyl, dimethylnaphthyl, ethylmethylnaphthyl, diethylnaphthyl, dipropylnaphthyl and dibutylnaphthyl groups, and isomeric forms thereof; or arylalkyl groups such as benzyl, phenylethyl and phenylpropyl groups, and isomeric forms thereof.

$R^1$ and $R^2$ in formula (1) are preferably hydrogen atoms, straight-chain or branched alkyl group having 1 to 18 carbon atoms, phenyl groups, or alkylphenyl groups, whose alkyl chains are straight or branched, having 7 to 18 carbon atmos. Specifically, $R^1$ and $R^2$ are preferably hydrogen atoms; methyl, ethyl, propyl, butyl, pentyl, hexyl, heptyl, octyl, decyl, dodecyl, tetradecyl, hexadecyl, octadecyl, phenyl, tolyl, ethylphenyl, propylphenyl, butylphenyl, pentylphenyl, hexylphenyl, heptylphenyl, octylphenyl, nonylphenyl, decylphenyl, dodecylphenyl or xylyl groups; or isomeric forms thereof.

Furthermore, in the light of cleanliness, $R^1$ in formula (1) is preferably a hydrogen atom or a straight-chain or branched alkyl group having 1 to 4 carbon atoms (preferably a straight-chain alkyl group), more preferably a hydrogen atom, methyl, ethyl or propyl group or any one of their isomeric forms.

From the same viewpoint, $R^2$ in formula (1) is preferably a hydrocarbon group such as a straight-chain or branched alkyl group having 1 to 4 carbon atoms(preferably a straight-chain alkyl group), or an alkylphenyl group having 7 to 18 carbon atoms which consists of a phenyl group substituted by a straight-chain or branched alkyl group, among which methyl, ethyl, propyl, butyl, phenyl, tolyl, ethylphenyl, propylphenyl, butylphenyl, pentylphenyl, hexylphenyl, heptylphenyl, octylphenyl, nonylphenyl, decylphenyl, dodecylphenyl or xylyl group, or any one of isomeric forms thereof.

On the other hand, $R^3$, $R^4$, $R^5$ and $R^6$ in formula (1) represent hydrogen atoms, methyl or ethyl groups, and the total number of carbons of $R^3$, $R^4$, $R^5$ and $R^6$ is 1 or 2.

Furthermore, a in formula (1) is an integer of 1 to 200, preferably 2 to 100, more preferably 5 to 50.

BEST MODE FOR CARRYING OUT THE INVENTION

As described above, polyoxyalkylene glycol derivatives which can be used in a lubricating oil for two-cycle engines of the present invention have polyalkylene chains of formula (5).

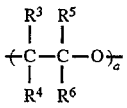

(5)

The structure of formula (5) is one of the followings.

1) a homopolymer structure which has a single constitutional unit selected from the members of the group represented by formula (6);

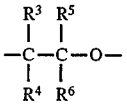

(6)

2) a random copolymer or block copolymer structure which has at least two kinds of constitutional unit selected from the members of the group represented by formula (6), where a in formula (5) denotes the sum of polymerization degrees of the different oxyalkylene groups;

3) combination of at least two polymer structures selected from those included in the above 1) or 2), where a in formula (5) denotes the sum of polymerization degrees of the different oxyalkylene groups.

From the practical viewpoint, viscosity of component A at 100° C., although there is no restriction, is preferably 1 to 100 $mm^2/s$, more preferably 5 to 50 $mm^2/s$, but not limited to them.

If necessary, the lubricating oils of the present invention, which contain component A as a base oil, can contain at least one of mineral lubricating oils, synthetic lubricating oils and/or mineral diluents as base oils, which are soluble in component A. In general, the total amount of the base-oil ingredients other than component A is preferably 100 parts or less to 100 parts of component A by weight, more preferably 50 parts or less as long as they do not deteriorate the characteristics of the lubricating oils of the present invention, but not limited to them.

Although the lubricating oil of the present invention exclusively containing component A can give an excellent performance, at least one of the nitrogen-containing compounds of the following (a)–(d) (hereinafter referred to as "component B") can be added to improve cleanliness of an engine.

(a) a nitrogen-containing compound of formula (2) [hereinafter referred to as "component (a)"];

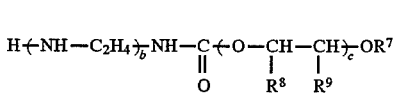

(2)

wherein $R^7$ is an alkyl group having 1 to 22 carbon atoms, an alkenyl group having 3 to 22 carbon atoms; a cycloalkyl or alkylcycloalkyl group having 5 to 15 carbon atoms, or an aryl, alkylaryl or arylalkyl group having 6 to 18 carbon atoms; $R^8$ and $R^9$ are hydrogen atoms or alkyl groups having 2 to 6 carbon atoms, where the total number of carbons of $R^8$ and $R^9$ is 2 to 8; b is an integer of 1 to 8; and c is an integer of 5 to 40;

(b) a boronated compound (a) [hereinafter referred to as "compound(b)"];

(c) a nitrogen-containing compound of formula (3) [hereinafter referred to as "component (c)];

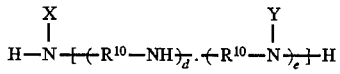

(3)

wherein X is a hydrogen atom or an acyl group having 6 to 30 carbon atoms derived from a fatty acid; Y is an acyl group having 6 to 30 carbon atoms derived from a fatty acid; $R^{10}$ is an alkylene group having 2 to 4 carbon atoms; d is an integer of 0 to 11; e is an integer of 0 to 11; 2>d+e>11; and one molecule contains at least one acyl group;

(d) a boronated compound (c) [hereinafter referred to as "component (d)"].

Component (a) is a nitrogen-containing compound represented by formula (2);

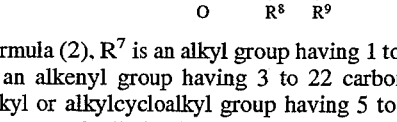

(2)

In formula (2), $R^7$ is an alkyl group having 1 to 22 carbon atoms, an alkenyl group having 3 to 22 carbon atoms, a cycloalkyl or alkylcycloalkyl group having 5 to 15 carbon atoms, or an aryl, alkylaryl or arylalkyl group having 6 to 18 carbon atoms. Specifically, $R^7$ is an alkyl group such as methyl, ethyl, propyl, butyl, pentyl, hexyl, heptyl, octyl, nonyl, decyl, undecyl, dodecyl, tridecyl, tetradecyl, pentadecyl, hexadecyl, heptadecyl, octadecyl, nonadecyl and eicosyl groups, and any one of isomeric forms thereof; an alkenyl group such as propenyl, isopropenyl, butenyl, pentenyl, hexenyl, heptenyl, octenyl, nonenyl, decenyl, undecenyl, dodecenyl, tridecenyl, tetradecenyl, pentadecenyl, hexadecenyl, heptadecenyl, octadecenyl, nonadecenyl and eicosenyl groups, and any one of isomeric forms thereof; a cycloalkyl group such as cyclopentyl, cyclohexyl and cycloheptyl groups; an alkylcycloalkyl group such as methylcyclopentyl, ethylcyclopentyl, propylcyclopentyl, butylcyclopentyl, dimethylcyclopentyl, ethylmethylcyclopentyl, diethylcyclopentyl, dipropylcyclopentyl, dibutylcyclopentyl, methylcyclohexyl, ethylcyclohexyl, propylcyclohexyl, butylcyclohexyl, dimethylcyclohexyl, ethylmethylcyclohexyl, diethylcyclohexyl, dipropylcyclohexyl, dibutylcyclohexyl, methylcycloheptyl, ethylcycloheptyl, propylcycloheptyl, butylcycloheptyl, dimethylcycloheptyl, ethylmethylcycloheptyl, diethylcycloheptyl, dipropylcycloheptyl and dibutylcycloheptyl groups, and any one of isomeric forms thereof; an aryl group such as phenyl and naphthyl groups including all isomeric forms thereof; an alkylaryl group such as tolyl, ethylphenyl, propylphenyl, butylphenyl, pentylphenyl, hexylphenyl, heptylphenyl, octylphenyl, nonylphenyl, decylphenyl, undecylphenyl, dodecylphenyl, xylyl, ethylmethylphenyl, diethylphenyl, dipropylphenyl, dibutylphenyl, methylnaphthyl, ethylnaphthyl, propylnaphthyl, butylnaphtyl, dimethylnaphthyl, ethylmethylnaphthyl, diethylnaphthyl, dipropylnaphthyl and dibutylnaphthyl groups, and any one of isomeric forms thereof; or an arylalkyl group such as benzyl, phenylethyl and phenylpropyl groups, and any one of isomeric forms thereof.

$R^7$ in formula (2) is preferably a straight-chain or branched alkyl group having 1 to 18 carbon atoms, phenyl, or an alkylphenyl group having 7 to 18 carbon atoms whose alkyl chains are straight or branched. Specifically, $R^7$ is methyl, ethyl, propyl, butyl, pentyl, hexyl, heptyl, octyl, decyl, dodecyl, tetradecyl, hexadecyl, octadecyl, phenyl, tolyl, ethylphenyl, propylphenyl, butylphenyl, pentylphenyl, hexylphenyl, heptylphenyl, octylphenyl, nonylphenyl, decylphenyl, dodecylphenyl or xylyl group, or any one of their isomeric forms.

$R^8$ and $R^9$ in formula (2) include hydrogen atoms or alkyl groups having 2 to 6 carbon atoms, and the total number of carbons of $R^8$ and $R^9$ is 2 to 8, preferably 2 to 6. Specifically, $R^8$ and $R^9$ are ethyl, propyl, butyl, pentyl or hexyl group, or any one of isomeric forms thereof, most preferably ethyl group.

In formula (2), b is an integer of 1 to 8, preferably 1 to 6, and c is an integer of 5 to 40, preferably 10 to 30.

Furthermore, component (b) mentioned above is a compound obtained through reaction of component (a) with a boronating agent.

The above boronating agent can be any of boronating agents capable of reacting with component (a) to form a nitrogen-containing boron compound, for example, an acid such as orthoboric acid ($H_3BO_3$), metaboric acid ($HBO_2$), tetraboric acid ($H_2B_4O_7$) or boric anhydride; an oxide of boron such as boron oxide ($B_2O_3$); a boron halide such as boron fluoride, boron chloride and boron bromide; a borate such as ammonium borate, sodium borate and potassium borate; or a lower alkyl ester of boric acid represented by formula (7);

$$(R^{17}-O)_g-B(-OH)_h \qquad (7)$$

wherein $R^{17}$ is an alkyl group having 1 to 6 carbon atoms, g is an integer of 1 to 3, h is an integer of 0 to 2, and g+h=3.

The boronating agent is preferably mono-, di- or trimethyl borate; mono-, di- or triethyl borate; mono-, di- or tripropyl borate; mono-, di- or tributyl borate; mono-, di- or tripentyl borate; mono-, di- or trihexyl borate; or any one of mixtures thereof, more preferably, an acid of boron, a lower alkyl ester of boric acid or any one of mixtures thereof.

It is preferable to use the boronating agent in an adequate amount in the boronating reaction to obtain a final boron compound containing boron in the range of 0.05–7.0 wt %, but not limited to it. The ratio of boron atoms of a boronating agent to nitrogen atoms of a nitrogen-containing compound of formula (2) is preferably 0.05–10:1, more preferably 0.1–2:1.

Boronation with a boronating agent is carried out by heating a nitrogen-containing compound of formula (2) with the boronating agent. The boronation can be carried out in the presence of water, alcohol and/or hydrocarbon, as convenient. In the reaction, water or alcohol is a "reactive solvent" which reacts with the boronating agent to form a reactive intermediate suitable for the boronation, resulting in an increase of yield, while hydrocarbon is an "inert solvent" which can azeotropically remove the water produced during the boronation.

Alcohols preferably used in the reaction include methanol, ethanol, propanol, isopropanol, n-butanol, sec-butanol, pentanol (amyl or iso-amyl alcohol), hexanol, ethylene glycol, propylene glycol, butylene glycol, pentylene glycol, hexylene glycol and so forth.

Hydrocarbons preferably used in the reaction include those whose boiling point is 60° C. or above, for example, benzene, toluene, xylene, benzine, lygroin, mineral spirit, cleaning solvent, petroleum naphtha, cyclohexane, hexane, mineral oil, and naphtha fraction, kerosine fraction, gas oil fraction or lubricating oil fraction of mineral oil.

In order to react a boronating agent with a nitrogen-containing compound represented by formula (2), reaction temperature during the boronation reaction should be to some extent higher than ambient temperature, preferably 50° to 250° C., more preferably 80° to 180° C., and a refluxing temperature of the solvent used is usually chosen. Since a boronation reaction can be usually completed in a short period of time, the reaction will be carried out for 0.5 to 8 hours, preferably 2 to 6 hours.

After completing the boronation, the reaction mixture is heated to distill off the water produced during the reaction and any other solvents if used, and the water is usually removed by a desiccant such as sodium sulfate and magnesium sulfate. Then, the desired compound, component (b), can be obtained either 1) by diluting the reaction mixture with organic solvent such as benzene, toluene, xylene, hexane, benzine, gasoline for rubber or petroleum ether and removing the unreacted boronating agent by filtration or solvent extraction, or 2) through purification process such as distillation under a reduced pressure, as appropriate.

The ratio of the number of nitrogen atoms to the number of boron atoms in the nitrogen-containing compound can be controlled by adjusting the ratio of the amount of a boronating agent to a nitrogen-containing compound, and is preferably from 1:0.05 to 1:5, more preferably from 1:0.1 to 1:2.

Component (c) is a nitrogen-containing compound represented by formula (3);

$$H-\overset{X}{\overset{|}{N}}-(R^{10}-NH)_d-(R^{10}-\overset{Y}{\overset{|}{N}})_e-H \qquad (3)$$

In formula (3), X is a hydrogen atom or an acyl group having 6 to 30, preferably 12 to 20 carbon atoms which is derived from a fatty acid; Y is an acyl group having 6 to 30, preferably 12 to 20 carbon atoms which is derived from a fatty acid; $R^{10}$ is an alkylene group having 2 to 4, preferably 2 or 3 carbon atoms; d is an integer of 0 to 11, preferably 3 to 11, more preferably 4 to 11; e is an integer of 0 to 11; $2<d+e<11$; and one molecule contains at least one acyl group. The fatty acid from which X or Y is derived can be a saturated or unsaturated fatty acid having 6 to 30 carbon atoms, preferably a saturated fatty acid having 12 to 20 carbon atoms, for example, a straight-chain or branched acid such as dodecanoic acid, tridecanoic acid, tetradecanoic acid, pentadecanoic acid, hexadecanoic acid, heptadecanoic acid, octadecanoic acid, nonadecanoic acid, eicosanic acid, isododecanoic acid, isotridecanoic acid, isotetradecanoic acid, isopentadecanoic acid, isohexadecanoic acid, isoheptadecanoic acid, isooctadecanoic acid, isononadecanoic acid, isoeicosanic acid, or any one of mixtures thereof. The alkylene group, $R^{10}$, can be ethylene, propylene, trimethylene, tetramethylene, butylene, isobutylene or methyltrimethylene group, preferably ethelene, propylene or trimethylene group, most preferably ethylene group.

Component (c) is commercially available, or can be prepared by acylation of a polyalkylenepolyamine whose preferable structure is represented by formula (8).

$$H_2N(-R^{10}-NH)_i-H \quad (8)$$

In formula (8), $R^{10}$ represents the same as $R^{10}$ in formula (3), and i is an integer of 2 to 11, preferably 3 to 11, more preferably 4 to 11.

Examples of the above polyalkylenepolyamine include diethylenetriamine, triethylenetetramine, tetraethylenepentamine, pentaethylenehexamine, hexaethyleneheptamine, heptaethyleneoctamine, octaethylenenonamine, nonaethylenedecamine, decaethyleneundecamine, undecaethylenedodecamine, dipropylenetriamine, tripropylenetetramine, tetrapropylenepentamine, pentapropylenehexamine, hexapropyleneheptamine, heptapropyleneoctamine, octapropylenenonamine, nonapropylenedecamine, decapropyleneundecamine, undecapropylenedodecamine, di(trimethylene)triamine, tri(trimethylene)tetramine, penta(trimethylene)hexamine, hexa(trimethylene)heptamine, hepta(trimethylene)octamine, octa(trimethylene)nonamine, nona(trimethylene)decamine, deca(trimethylene)undecamine and undeca(trimethylene)dodecamine.

Examples of the above acylating agent include a fatty acid having 6 to 30, preferably 12 to 20 carbon atoms, and its derivative such as an acid halide and an acid anhydride.

An acylating agent for the above polyalkylenepolyamine is used preferably in the amount of 0.1–1 moles per 1 mole of the polyalkylenepolyamine. The acylation can be carried out under the conditions, e. g., reaction temperature, reaction time, catalyst and solvent, analogous to those usually applied to an acylation reaction and which are determined taking into consideration the types of the polyalkylenepolyamine and/or the acylating agent used, as convenient.

Component (d) can be obtained by a reaction of component (c) with a boronating agent, in which the boronating agent and the procedure of the boronation can be analogous to those used in the preparation of component (b), except that the amount of the boronating agent is from 0.05 to 5.0, preferably from 0.1 to 3.0 moles per 1 mol of component (c). It is recommended that in the reaction system the ratio of boron atoms to nitrogen atoms of compound (d) in number is 0.02–10, preferably 0.05–5.0, more preferably 0.1–2.

Component B is added to a lubricating oil for two-cycle engines comprising compound A as a base oil either directly or in the form of dilution of kerosine, lubricating oil or the like, to form a lubricating oil composition of the present invention, in which the content of compound B is 0.5–30 wt %, preferably 1–20 wt %, more preferably 3–10 wt %. Cleanliness will not be improved very much if the content of component B is below that range, while, if above, compound B does not improve cleanliness in proportion to the amount used, resulting in decrease of an economical efficiency. Hence, neither of these cases are preferable.

Although there is no limitation in a process of mixing component A and B to prepare a lubricating oil composition for two-cycle engines of the present invention, it can be usually obtained by stirring a mixture of these compounds at 20° to 80° C. for 30 min to 3 hours.

The lubricating oil composition for two-cycle engines of the present invention, which is excellent in cleanliness at low or high temperature, can be obtained by adding at least one nitrogen-containing compound selected from component (c) and (d) preferably to a polyalkylene glycol derivative as a base oil represented by formula (4);

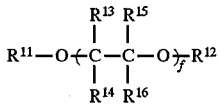

$$R^{11}-O-(C(R^{13})(R^{14})-C(R^{15})(R^{16})-O)_f-R^{12} \quad (4)$$

wherein $R^{11}$ and $R^{12}$ represent hydrogen atoms, alkyl groups having 1 to 4 carbon atoms, aryl, alkylaryl or arylalkyl groups having 6 to 20 carbon atoms, and $R^{11}$ and/or $R^{12}$ are aryl, alkylaryl or arylalkyl groups having 6 to 20 carbon atoms; $R^{13}$, $R^{14}$, $R^{15}$ and $R^{16}$ are hydrogen atoms, methyl groups or ethyl groups, and the total number of carbons of $R^{13}$, $R^{14}$, $R^{15}$ and $R^{16}$ is 1 or 2; and f is an integer of 1 to 200.

In order to further improve the excellent characteristics of the lubricating oil for two-cycle engines of the present invention, if necessary, known additives for lubricating oil such as antioxidant, load-resistant additive, metallic cleaner, ash-free dispersant, metal-inactivating agent, viscosity index improver, pour point depressant and defoaming agent, can be added to the lubricating oil, either solely or in combination of two or more thereof. It is important that these additives except deforming agent can be homogenously dissolved in a base oil of the lubricating oil for two-cycle engines of the present invention without turbidity or precipitation, and that, if added, they should be deliberately chosen. It is preferable to control the total content of the additives below or equal to 20 wt % to the total weight of the composition, but not limited.

Two-cycle engines referred to in the present invention are engines having a mechanism by which combustion is completed in one rotation of a crank-shaft. The two-cycle engines can be used for various kinds of machine, for example, motorcycles, carts, snowmobiles, outboard motors, motorboats, marine skis, generators, chain saws, lawn mowers, sprays, pilotless light airplanes, fire pumps and so forth, without particular limitations.

The lubricating oil or oil composition for two-cycle engines of the present invention can be used to lubricate two-cycle engines without particular limitations in its usage. For example, the above-mentioned lubricating oil or oil composition hereinafter referred to as "the Oil") can be fed into an engine in 1) a "mixed-oil system" in which the Oil and fuel are premixed, placed in a fuel tank and vaporized to be fed into a crank case used as a pilot pressure chamber, or 2) a "separate-oil system" in which fuel and the Oil are placed in separate tanks and the Oil is fed into a crank case by an oil pump. The Oil fed into a crank case in a manner described above lubricates bearing portions and frictional portions of the engine. The bearing portions herein include crank bearings, connecting rod small end bearings, connecting rod large end bearings and a piston pin, and the frictional portions include a piston, a cylinder and a piston ring.

EXAMPLES

Next, although the present invention will be more specifically described in reference to examples and comparative examples, it is to be understood that the scope of the present invention should not be limited to these examples at all.

In the following examples, derivatives A to I used as base oils belong to component A, each of which is specifically shown in Table 1 by specifying $R^1$ to $R^6$ and a in formula (1).

TABLE 1

| Polyoxy-alkylene Glycol Derivative | $R^1$— | $R^2$— | $R^3$— | $R^4$— | $R^5$— | $R^6$— | Average numbers of a (100° C.) | Kinematic Viscosity ($mm^2$/sec) |
|---|---|---|---|---|---|---|---|---|
| A | H— | $C_4H_9$— | $CH_3$— | H— | H— | H— | 24 | 11.3 |
| B | H— | $C_4H_9$— | $CH_3$— | H— | H— | H— | 53 | 34.8 |
| C | H— | $C_9H_{19}$* 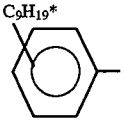 | $CH_3$— | H— | H— | H— | 14 | 12.8 |
| D | $CH_3$— | $C_4H_9$— | $CH_3$— | H— | H— | H— | 24 | 9.69 |
| E | $CH_3$— | $C_9H_{19}$* 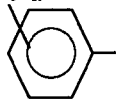 | $CH_3$— | H— | H— | H— | 14 | 10.6 |
| F | $CH_3$— | $C_2H_5$— | $CH_3$— | H— | H— | H— | 24 | 7.63 |
| G | H— | $CH_3$— | $C_2H_5$— | H— | H— | 11— | 14 | 11.2 |
| H | H— | $CH_3$ 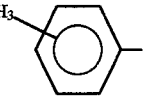 | $CH_3$— | H— | H— | H— | 26 | 10.7 |
| I** | H— | $C_4H_9$— | $CH_3$—<br>$C_2H_5$— | H—<br>H— | H—<br>H— | H—<br>H— | 8<br>8 | 8.38 |

*$C_9H_{19}$ is an alkyl group derived from a trimer of propylene.
**The polyoypropylene group represented by formula (i) is formed by random copolymerization of 8(average) of oxypropylene units of formula (ii) with 8(average) of oxybutylene units of formula (iii).

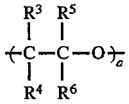
(i)

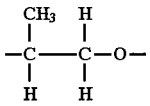
(ii)

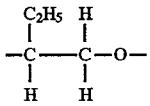
(iii)

In the following examples, nitrogen-containing compound A belongs to component (a) and is represented by formula (9).

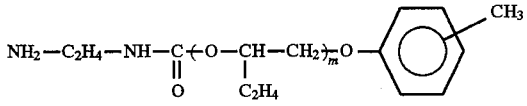
(9)

m ≈ 25

A boronated nitrogen-containing compound A in the following examples belongs to component (b) and was prepared by the following boronation.

Boronation

In one-liter flask equipped with a condenser having a water trap, a nitrogen-blowing tube, a thermometer and a stirrer were placed 600 g of nitrogen-containing compound A and 10.6 g of orthoboric acid, and then were heated with stirring under nitrogen stream. Reaction was carried out at 120° C. for about 3 hours. When water was condensed as much as 3 ml in the trap, the reaction mixture was transferred to a one-liter egg-plant type flask and was distilled at 120° C. under the pressure of 0.1 mmHg for 1 hour to obtain a yellowish transparent viscous product of boronated nitrogen-containing compound A, i.e., a boric-acid-modified compound). The result of its elemental analysis( nitrogen 1.6 wt %; boron 0.59 wt %) indicated that the product was the compound represented by formula (10).

(10)

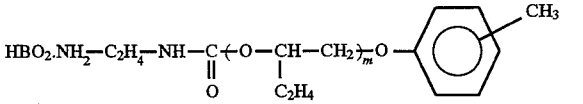

m ≈ 25

Nitrogen-containing compound B used in Example 1 is the compound represented by formula (11), which was prepared by the following process.

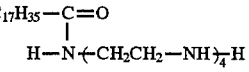

(11)

Preparation Example

In a one liter round-bottom flask equipped with a stirrer, a reflux condenser, a thermometer and a nitrogen-blowing tube were placed 0.1 mol (19 g) of tetraethylenepentamine, 200 ml of 10% sodium hydroxide and 300 ml of benzene, and the flask was cooled on an ice bath to 5° C. or below. Next, 0.2 mol (60.5 g) of isooctadecanoyl chloride was dropped over 1 hour, and then, the solution was stirred at 5° C. or below for further 1 hour. The solution was heated to reflux at the boiling point of benzene for 1 hour, and then allowed to cool. The contents in the reaction vessel were transferred into a one liter separatory funnel, and the lower layer was removed. The upper benzene layer was washed 5 times with 300 ml of purified water. After drying over anhydrous sodium sulfate, benzene was evaporated to obtain a light yellow transparent viscous liquid. Yield was 68 g. The result of elemental analysis of the product was carbon 75.2 wt %, hydrogen 13.1 wt % and nitrogen 9.2 wt %.

The boronated nitrogen-containing compound B used in the following examples is a compound prepared by boronation of nitrogen-containing compound B according to the process described below.

Boronation

Fifty grams of nitrogen-containing compound B prepared in the above preparation example was placed in the same type of 500-ml reaction vessel as that used in the above preparation example having a water trap between the flask and a reflux condenser, and 300 ml of toluene and 0.14 mol (8.6 g) of boric acid were then added. With stirring the solution was heated to reflux at the boiling point of toluene. Heating was stopped when about 2 ml of water was condensed in the trap (after about 3 hours). After cooling, the solution was dried over anhydrous sodium sulfate, and toluene was evaporated.

The reaction product was more viscous liquid than nitrogen-containing compound B prepared in the above preparation example.

Examples 1 to 17 and Comparative Examples 1 to 4

In Examples 1 to 17, the components shown in Table 2(I)–(VI) were blended to prepare lubricating oils for two-cycle engines of the present invention.

Performance Evaluation

Performance of the lubricating oils for two-cycle engines of the present invention shown in Table 2(I)–(VI) were evaluated as described below, whose results are shown in Table 2(I)–(VI).

For comparison, the same evaluation was carried out with mineral oil (Comparative Example 1), polybutene (Comparative Example 2) and commercially available two-cycle engine oils (Comparative Examples 3 and 4), whose results are shown in Table 2(VI).

(1) Smoke Test

Using a motorcycle equipped with a two-cycle engine (air-cooling type, 49 cc), concentration of smoke exhausted from its muffler was visually evaluated. Specifically, evaluation was performed under three kinds of driving condition (idling, rapid starting, steady-state running at 40 km/hr), and smokes observed were rated into 6 grades of 0 to 5 (0=best).

(2) Starting Performance Test

A motorcycle equipped with a two-cycle engine (air-cooling type, 49 cc) was driven on road for about 10 km, and was allowed to stand indoors for one hour and then at −5° C. for 3 hours. Next, constant current(120 A) was applied to its starter motor for 10 seconds from outside of the cold room to start the engine, and the time required to complete 4 rotations of its crank was recorded. The time was used as a standard for starting performance evaluation. The shorter the time is, the better starting performance is.

TABLE 2(I)

| | Composition (A number in [ ] is wt %) | | | Kinematic Viscosity |
|---|---|---|---|---|
| | Base oil | Additive | Others | ($mm^2/s$) |
| Example 1 | Polyalkylene Glycol A [100.0] | — | — | 11.3 |
| Example 2 | Polyalkylene Glycol B [65.0] | — | Kerosine [35.0] | 8.52 |
| Example 3 | Polyalkylene Glycol C [100.0] | — | — | 12.8 |
| Example 4 | Polyalkylene Glycol D [100.0] | — | — | 9.69 |
| Example 5 | Polyalkylene Glycol E [100.0] | — | — | 10.6 |
| Example 6 | Polyalkylene Glycol F [100.0] | — | — | 7.63 |
| Example 7 | Polyalkylene Glycol G [100.0] | — | — | 11.2 |
| Example 8 | Polyalkylene Glycol H [100.0] | — | — | 10.7 |
| Example 9 | Polyalkylene Glycol I [100.0] | — | — | 8.38 |
| Example 10 | Polyalkylene Glycol A [92.0] | Nitrogen-containing Compound A [4.0] | Kerosine [4.0] | 10.2 |
| Example 11 | Polyalkylene Glycol A [87.5] | Boronated Nitorgen-containing Compound A [4.0] | Kerosine [8.5] | 9.05 |
| Example 12 | Polyalkylene Glycol A [57.5] Polyalkylene Glycol B [19.5] | Nitrogen-containing Compound A [4.0] | Kerosine [19.0] | 8.45 |
| Example 13 | Polyalkylene Glycol C [80.2] | Boronated Nitrogen-containing Compound A [4.0] | Kerosine [15.8] | 8.81 |

TABLE 2(III)

| | Composition (A number in [ ] is wt %) | | | Kinematic Viscosity |
|---|---|---|---|---|
| | Base oil | Additive | Others | ($mm^2/s$) |
| Example 14 | Polyalkylene Glycol C [90.0] | — | Kerosene [10.0] | 8.77 |
| Example 15 | Polyalkylene Glycol C [86.0] | Nitrogen-containing Compound B [2.0] | Kerosine [12.0] | 8.33 |

TABLE 2(III)-continued

| | Composition (A number in [ ] is wt %) | | | Kinematic Viscosity |
|---|---|---|---|---|
| | Base oil | Additive | Others | ($mm^2/s$) |
| Example 16 | Polyalkylene Glycol C [64.0] | Nitrogen-containing Compound B [20.0] | Kerosine [16.0] | 13.4 |
| Example 17 | Polyalkylene Glycol C [86.0] | Boronated Nitrogen-containing Compound A [2.0] | Kerosine [12.0] | 8.56 |

TABLE 2(IV)

| | Composition (A number in [ ] is wt %) | | | Kinematic Viscosity |
|---|---|---|---|---|
| | Base oil | Additive | Others | ($mm^2/s$) |
| Comparative Example 1 | Mineral Oil Purified with Solvent[1] [86.5] | Additive Package[2] [5.0] | Kerosine [8.5] | 8.55 |
| Comparative Example 2 | Polybutene[3] [76.0] | Additive Package[2] [5.0] | Kerosine [19.0] | 8.63 |
| Comparative Example 3 | Commercially Available Lubricating Oil A for Two-cycle Engines[4] | | | 8.29 |
| Comparative Example 4 | Commercially Available Lubricating Oil B for Two-cycle Engines[5] | | | 8.55 |

[1]Kinematic viscosity = 10.8 $mm^2/s$ (100° C.)
[2]Contains Ca detergents and ash-free dispersant (Ca content = 0.6 wt %; N content = 1.4 wt %)
[3]Kinamatic viscosity = 23.0 $mm^2/s$ (100° C.)
[4]Ca content = 0.03 wt %; N content = 0.10 wt % (including Ca detergents and ash-free dispersant)
[5]Ca content = 0.05 wt %; N content = 0.06 wt % (including Ca detergents and ash-free dispersant)

TABLE 2(V)

| | Smoke Test(0 = best) | | | Engine Starting |
|---|---|---|---|---|
| | Idling | Rapid Starting | Steady-state Running | Performance Test (sec) |
| Example 1 | 1 | 1 | 0 | 3.85 |
| Example 2 | 0 | 0 | 0 | 3.80 |
| Example 3 | 1 | 1 | 0 | 3.97 |
| Example 4 | 1 | 1 | 0 | 3.83 |
| Example 5 | 1 | 2 | 0 | 3.92 |
| Example 6 | 1 | 1 | 0 | 3.80 |
| Example 7 | 1 | 1 | 0 | 3.87 |
| Example 8 | 1 | 2 | 0 | 3.87 |
| Example 9 | 1 | 1 | 0 | 3.93 |
| Example 10 | 1 | 1 | 0 | 3.87 |
| Example 11 | 1 | 1 | 0 | 3.97 |
| Example 12 | 1 | 1 | 0 | 3.63 |

TABLE 2(VI)

| | Smoke Test(0 = best) | | | Engine Starting |
|---|---|---|---|---|
| | Idling | Rapid Starting | Steady-state Running | Performance Test (sec) |
| Example 13 | 1 | 1 | 0 | 3.80 |
| Example 14 | 1 | 1 | 0 | 3.78 |
| Example 15 | 1 | 1 | 0 | 3.76 |
| Example 16 | 1 | 1 | 0 | 3.90 |
| Example 17 | 1 | 1 | 0 | 3.76 |
| Comparative Example 1 | 4 | 5 | 4 | 4.32 |
| Comparative Example 2 | 1 | 2 | 0 | 7.95 |
| Comparative Example 3 | 2 | 3 | 2 | 7.84 |
| Comparative Example 4 | 3 | 4 | 2 | 6.82 |

High-Temperature Cleanliness Test using a Motorcycle Engine

For the lubricating oils for two-cycle engines of Examples 1, 10, 11, 15 and 17 of the present invention and the commercially available lubricating oils for two-cycle engines of Comparative Examples 3 and 4, high-temperature cleanliness was tested using a motorcycle engine.

An air-cooling type of two-cycle engine for motorcycles having a 123 cc displacement single cylinder was driven for 5 hours under conditions of an engine rotational frequency of 5000 rpm, full load, a plug seat temperature of 200° C. and a fuel:oil mixing ratio of 40:1. Then, cleanliness of the engine was visually evaluated. The results are shown in Table 3. Cleanliness was rated into 11 grades of 0 to 10 (10=best).

TABLE 3

| | Ex. 1 | Ex. 10 | Ex. 11 | Ex. 15 | Ex. 17 | Compar. Ex. 3 | Compar. Ex. 4 |
|---|---|---|---|---|---|---|---|
| Ring Sticking Top | 10 | 10 | 10 | 10 | 10 | 5.0 | 5.0 |
| Ring Sticking Second | 10 | 10 | 10 | 10 | 10 | 10 | 10 |
| Ring Groove Top | 7.9 | 8.6 | 9.0 | 8.9 | 9.0 | 2.9 | 0 |
| Ring Groove Second | 7.4 | 8.4 | 8.2 | 7.9 | 8.5 | 1.7 | 6.4 |
| Ring Land Top | 7.2 | 6.9 | 8.0 | 7.0 | 8.1 | 3.8 | 5.9 |
| Ring Land Second | 7.2 | 8.3 | 7.6 | 7.4 | 8.4 | 6.2 | 8.3 |
| Piston Skirt | 9.1 | 9.6 | 9.3 | 9.3 | 9.5 | 9.8 | 9.6 |
| Under-crown | 5.3 | 5.7 | 7.7 | 6.5 | 7.0 | 1.3 | 3.5 |
| Total Merit Rating (Best = 80) | 64.1 | 67.5 | 69.8 | 67.0 | 70.5 | 40.7 | 48.7 |

Low-temperature Cleanliness Test

For the lubricating oils for two-cycle engines of Exmaples 14, 15 and 17 of the present invention and the commercially available lubricating oil for two-cycle engines of Comparative Example 3, low-temperature cleanliness was tested using a motorcycle engine. The test was conducted using a generator. The engine was discontinuously driven at a plug seat temperature of about 130° C., and then cleanliness of the engine was visually evaluated. The test conditions were determined to simulate running conditions with an engine whose inner temperature does not rise very much, e.g., an engine of a motorcycle for newspaper delivery which is exposed to frequent repetition of start-and-stop. The results are shown in Table 4. Cleanliness was rated into 11 grades of 0 to 10 (10=best).

TABLE 4

Evaluation Results of Low-temperature Cleanliness

| | Ex. 14 | Ex. 15 | Ex. 17 | Compar. Ex. 3 |
|---|---|---|---|---|
| Ring Sticking Top | 10 | 10 | 10 | 10 |
| Ring Sticking Second | 10 | 10 | 10 | 10 |
| Ring Groove Top | 6.7 | 8.9 | 9.1 | 7.0 |
| Ring Groove Second | 8.1 | 9.9 | 10 | 7.8 |
| Ring Land Top | 5.1 | 10 | 10 | 3.9 |
| Ring Land Second | 7.6 | 10 | 10 | 7.6 |
| Piston Skirt | 7.6 | 10 | 10 | 7.5 |
| Under-crown | 9.9 | 10 | 10 | 9.5 |
| Total Merit Rating (Best = 80) | 65.0 | 78.8 | 79.1 | 63.3 |

Evaluation of Clogging of an Exhaust System

To evaluate a degree of power reduction due to deposition of carbon and so on in a muffler, clogging of an exhaust system was tested for the lubricating oils for two-cycle engines of Examples 1, 14, 15 and 17 of the present invention, and the mineral oil-based lubricating oil for two-cycle engines of Comparative Example 1 and the low-smoke type of polybutene-based lubricating oil for two-cycle engines of Comparative Example 3, in accordance with JASO M343-92 of Society of Automotive Engineers of Japan's Standards. The test was conducted using a generator in compliance with the procedure described in the JASO Standards. In this test was measured the time required to raise an inlet negative pressure to 2 kPa under mode driving in which load condition, i.e., non-load or 750 W load, was controlled through monitoring a temperature of exhaust gas. The results are shown in Table 5, in which values are clogging indexes assuming that the clogging index of the standard oil (JATRE-1) is 100, according to the evaluation method prescribed in JASO M343-92, and the larger an index, the less likely clogging occurs. JATRE-1 is used as a standard oil because its performance represents that of a low-smoke type of lubricating oil for two-cycle engines. JASO M 345-93 prescribes that a low-smoke type of lubricating oil should have an clogging index of 90 or above, using JATRE-1 (=100) as a standard.

TABLE 5

Evaluation of Clogging of an Exhaust System

| | Ex. 1 | Ex. 14 | Ex. 15 | Ex. 17 | Comp. Ex. 1 | Comp. Ex. 3 |
|---|---|---|---|---|---|---|
| Clogging Index of an Exhaust System (JATRE-1 = 100) | 300 | 300 | 320 | 317 | 54 | 90 |

The compositions of Examples 1 to 17 are the lubricating oils for two-cycle engines, which contain polyalkylene glycol derivatives of the present invention as a base oil. As is apparent from the results of the performance evaluation in Table 2, these lubricating oils produce smoke remarkably less in comparison with a mineral oil (Comparative Example 1), and also less in comparison with polybutene (Comparative Example 2) or commercially available low-smoke type of lubricating oils for two-cycle engines containing polybutene as a component of a base oil (Comparative Examples 3 and 4).

On the other hand, the time required to start an engine is usually desired to be less than or equal to that of a lubricating oil containing mineral oil (Comparative Example 1). Any of the lubricating oils for two-cycle engines of Examples 1 to 17 of the present invention gave the time less than an oil containing mineral oil (Comparative Example 1) or a commercially available lubricating oil (Comparative Example 3 or 4), showing an excellent starting performance. In contrast to that, addition of polybutene has caused deterioration of starting performance of an engine (Comparative Example 2) due to its high viscosity.

As is apparent from the results in Table 3, the lubricating oils for two-cycle engines containing component B (Examples 10, 11, 15 and 17) have provided a high-temperature cleanliness superior to the lubricating oil of Example 1, definitely showing effectiveness of addition of component B.

Moreover, as is apparent from the results in Table 4, the lubricating oil for two-cycle engines containing component (c) or (d) (Examples 15 or 17) has provided a low-temperature cleanliness superior to the lubricating oil without component (c) or (d) (Example 14), definitely showing effectiveness of addition of component (c) or (d).

In addition, as is apparent from the results in Table 5, the lubricating oils for two-cycle engines of the present invention (Examples 1, 14, 15 and 17) have provided the time taken to occur clogging of a muffler three or more times longer than a conventional lubricating oil for two-cycle engines containing mineral oil (Comparative Example 1) or a conventional low-smoke type of lubricating oil for two-cycle engines (Comparative Example 3).

INDUSTRIAL APPLICABILITY

As described above, a lubricating oil for two-cycle engines of the present invention can remarkably inhibit generation of smoke and remarkably improve engine characteristics such as starting performance, cleanliness to prevent clogging with carbon of an exhaust system, high- or low temperature cleanliness of an engine, and anti-seizure performance.

We claim:

1. A lubricating oil composition for two-cycle engines which comprises (A) as a base oil a polyoxyalkylene glycol derivative represented by formula (1):

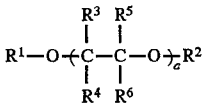

(1)

wherein $R^1$ and $R^2$ are hydrogen atoms, alkyl groups having 1 to 22 carbon atoms, alkenyl groups having 3 to 22 carbon atoms, cycloalkyl groups or alkylcycloalkyl groups having 5 to 20 carbon atoms, or aryl, alkylaryl or arylalkyl groups having 6 to 20 carbon atoms; $R^3$, $R^4$, $R^5$ and $R^6$ are hydrogen atoms, methyl groups or ethyl groups, and the total number of carbons of $R^3$, $R^4$, $R^5$ and $R^6$ is 1 or 2; and a is an integer of 1 to 200; and (B) a boronated nitrogen-containing compound wherein said nitrogen containing compound is represented by formula (2):

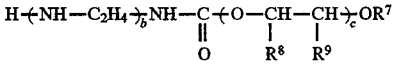

(2)

wherein $R^7$ is an alkyl group having 1 to 22 carbon atoms, an alkenyl group having 3 to 22 carbon atoms, a cycloalkyl or alkylcycloalkyl group having 5 to 15 carbon atoms, or an aryl, alkylaryl or arylalkyl group having 6 to 18 carbon atoms; $R^8$ and $R^9$ are hydrogen atoms or alkyl groups having 2 to 6 carbon atoms, and the total number of carbon atoms of $R^8$ and $R^9$ is from 2 to 8; b is an integer of 1 to 8; and c is an integer of 5 to 40, said compound being present in the amount of 0.5 to 30 wt % to the total weight of the composition.

2. A process for lubrication of a two-cycle engine, wherein a lubricating oil for two-cycle engines is fed into the two-cycle engine separately from fuel or mixed with fuel to lubricate bearing portions and frictional portions of the said engine, wherein the lubricating oil for two-cycle engines comprises (A) as a base oil a polyoxyalkylene glycol derivative represented by formula (1):

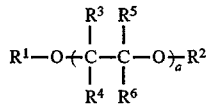

(1)

wherein $R^1$ and $R^2$ are hydrogen atoms, alkyl groups having 1 to 22 carbon atoms, alkenyl groups having 3 to 22 carbon atoms, cycloalkyl groups or alkylcycloalkyl groups having 5 to 20 carbon atoms; $R^3$, $R^4$, $R^5$ and $R^6$ are hydrogen atoms, methyl groups or ethyl groups, and the total number of carbons of $R^3$, $R^4$, $R^5$ and $R^6$ is 1 or 2; and a is an integer of 1 to 200; and (B) a boronated nitrogen-containing compound wherein said nitrogen containing compound is represented by formula (2):

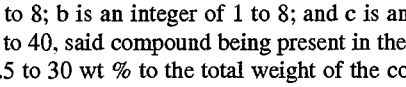

(2)

wherein $R^7$ is an alkyl group having 1 to 22 carbon atoms, an alkenyl group having 3 to 22 carbon atoms, a cycloalkyl or alkylcycloalkyl group having 5 to 15 carbon atoms, or an aryl, alkylaryl or arylalkyl group having 6 to 18 carbon atoms; $R^8$ and $R^9$ are hydrogen atoms or alkyl groups having 2 to 6 carbon atoms, and the total number of carbon atoms of $R^8$ and $R^9$ is from 2 to 8; b is an integer of 1 to 8; and c is an integer of 5 to 40, said compound being present in the amount of 0.5 to 30 wt % to the total weight of the composition.

* * * * *